United States Patent [19]

Beirnes

[11] 4,222,200

[45] Sep. 16, 1980

[54] COMBINATION WINDOW CASING AND STORM WINDOW FRAME

[76] Inventor: James R. Beirnes, P.O. Box 830, Joliet, Ill. 60434

[21] Appl. No.: 9,759

[22] Filed: Feb. 5, 1979

[51] Int. Cl.[2] ..... E05B 3/26

[52] U.S. Cl. ..... 49/63; 49/194; 49/504

[58] Field of Search ..... 49/62, 63, 504, 194, 49/455

[56] References Cited

U.S. PATENT DOCUMENTS

| | | | |
|---|---|---|---|
| 3,219,100 | 11/1965 | Johnston et al. | 49/63 X |
| 3,344,575 | 10/1967 | Grossman | 49/504 X |
| 4,048,774 | 9/1977 | Yamamoto | 49/63 X |

*Primary Examiner*—Kenneth Downey
*Attorney, Agent, or Firm*—John L. Parker

[57] ABSTRACT

A combination casing and frame for use both as the window casing and as a storm window frame for a double-hung structural window and adapted to be mounted directly against the frame of the structural window includes unitary top, side, and sill members, each of the top and side members having a casing portion adapted to overlie a portion of the structural window frame, structure for slidably mounting sashes on the side members, latch-engaging structure provided in the side members, and latches movably mounted on opposite sides of the sill member in retractable engagement with the latch-engaging structure, for mounting the sill member on the side members and demounting the sill member.

18 Claims, 7 Drawing Figures

12
28
146
82a
82
122
82b
32
40
22
142a
10
150
144a
42
38
144b
142b
86
3
3
182
184
180
86b
183
181
178
160
158
164
86
166
86a
162
176
172
170
184
182
180
160
168
158
162
168
174
186
142
144
144c
144d
86
36
34
136
134
132
52
48
64
62
174
70
24

COMBINATION WINDOW CASING AND STORM WINDOW FRAME

BACKGROUND AND OBJECTS OF THE INVENTION

This invention relates to window casings and frames. More particularly, the invention relates to a combination casing and frame for use both as the window casing and as a storm window frame for a double-hung structural window.

In providing storm windows for conventional double-hung structural windows in dwellings or the like, it has been common practice to mount a storm window frame to the structural window frame, and provide a separate casing around the storm window frame. At times, the storm window frame may be mounted to the casing around a structural window. The prior practices suffer from certain disadvantages, including loss of attractiveness with the addition of the storm window frames, the necessity for separate casings and frames, with accompanying substantial material, manufacturing, and installation costs, and lack of desired versatility.

Another objection to the use of prior storm window frames, which are permanently mounted in place over the structural windows, is that it is difficult or inconvenient to clean properly the dirt and debris which collect around the bases of the frames.

An important object of the present invention is to provide a combination window casing and storm window frame, which affords a number of advantages. The advantages include enhanced attractiveness, reduction in materials, lowered manufacturing cost, and decreased installation labor requirements.

An accompanying object is to provide a combination casing and frame which is suited for mounting directly on the frame of a conventional double-hung structural window, especially, against the blind stops defining a window opening in the structural frame.

Another important object is to provide a storm window frame incorporating a sill member which is removable or detachable for the purpose of cleaning the area around the base of the frame, especially, the structural window sill.

An accompanying object is to provide a storm window frame having a removable sill member, wherein the sill member is easily and rapidly mounted on and demounted from the side members of the frame.

Another accompanying object is to provide a storm window frame which incorporates a removable sill member and yet is relatively rigid.

An additional object is to provide a combination casing and frame incorporating unitary members, which may be manufactured integrally in one piece by relatively low cost methods, such as extrusion, and from preferred materials of construction, such as aluminum alloys and plastic materials.

SUMMARY OF THE INVENTION

The invention provides a combination casing and frame for use both as the window casing and as a storm window frame for a double-hung structural window and adapted to be mounted directly against the frame of the structural window, such combination casing and frame comprising: unitary top, side, and sill members, each of the top and side members having a casing portion adapted to overlie a portion of the structural window frame, means for slidably mounting sashes on the side members, the side members having latch-engaging means, and latches movably mounted on opposite sides of the sill member in retractable engagement with the latch-engaging means, for mounting the sill member on the side members and demounting the sill member.

While the complete combination of window casing and storm window frame is most advantageous, the provision of the removable sill member in a storm window frame is advantageous apart from the combination of the frame with a casing, and the invention also includes such provision of a removable sill member, In addition, the provision of a combination window casing and storm window frame is advantageous in structures wherein the sill member when assembled becomes a permanent part of the frame, and the invention includes such provision of a combination casing and frame.

BRIEF DESCRIPTION OF THE DRAWINGS

The foregoing and other objects, advantages and functions of the invention will be apparent on reference to the specification and to the attached drawings illustrating a preferred embodiment of the invention, in which drawings like reference symbols are applied to like parts in each of the views, and in which.

DESCRIPTION OF THE PREFERRED EMBODIMENT

Figure 1:
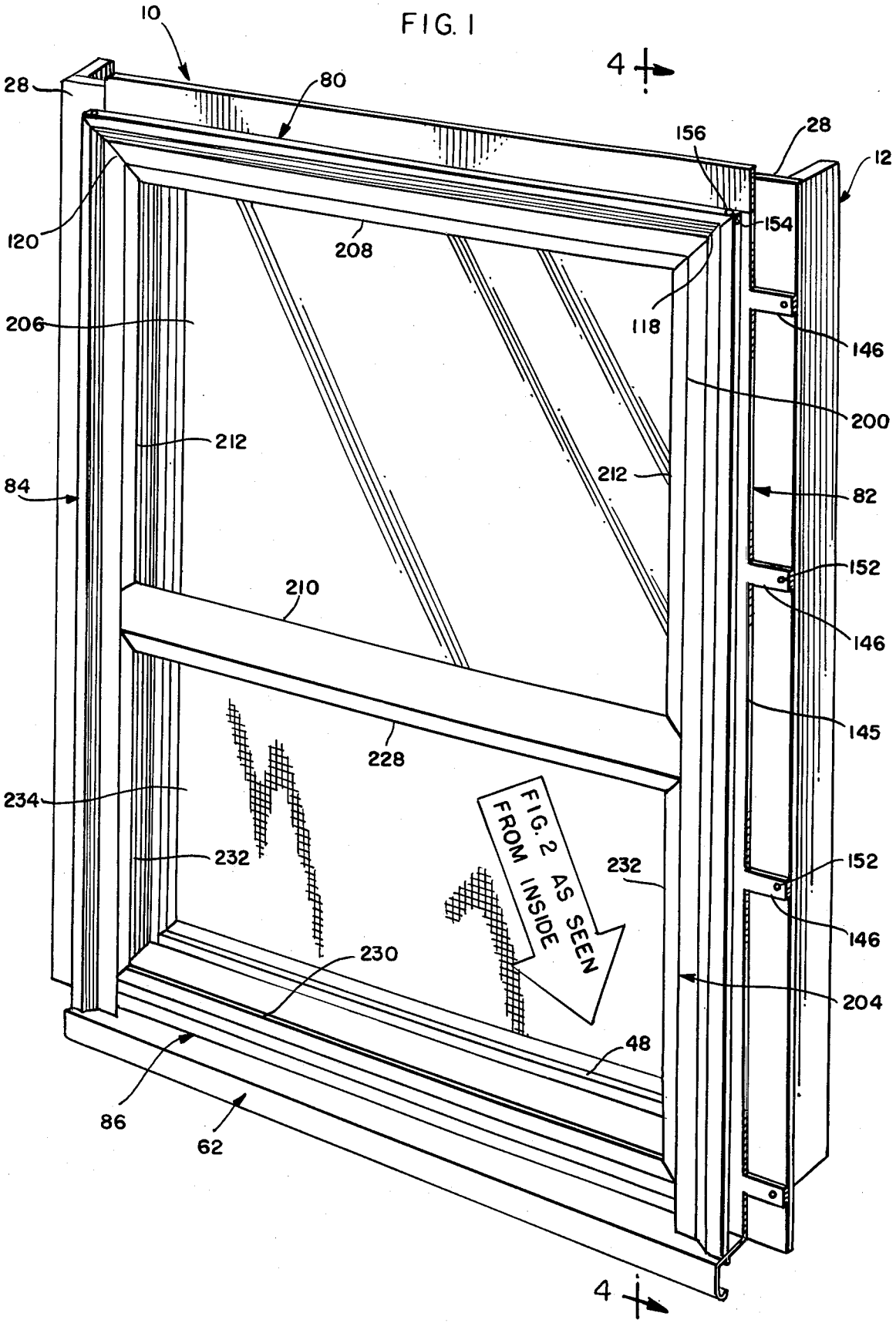
FIG. 1 is a front and side perspective view of a combination window casing and storm window frame in accordance with the invention, illustrated as mounted on the frame of a conventional double-hung structural window and having an upper storm window sash and a lower screen sash mounted in the frame of the combination.

Referring to the drawings, particularly FIGS. 1–4, a combination window casing and storm window frame 10 constituting a preferred embodiment of the invention is illustrated as mounted on the frame 12 of a conventional double-hung structural window 14 consisting of upper and lower sashes 16 and 18, respectively. The illustrative structure window frame 12 includes a horizontal head jamb 20, a pair of spaced parallel vertical side jambs 22 at opposite ends of the head jamb, and an outwardly and downwardly inclined inner sill 24 extending horizontally between the lower ends of the side jambs. The frame 12 also includes a horizontal blind stop 26 extending across the frame along the head jamb 20, and a pair of spaced parallel vertical blind stops 28 extending downwardly therefrom along the side jambs 22. The horizontal and vertical blind stops 26 and 28 are elongated strips rectangular in cross section which together with the inner sill 24 define a generally rectangular window opening 30 leading to the interior of an enclosure, such as a dwelling.

A sheet member 32 secured to each side jamb 22 is shaped or contoured to form tracks 34 and 36 for travel of the upper and lower sashs 16 and 18, respectively, and elongated vertical retainers 38, 40 and 42 of generally rectangular cross section, which bound the tracks. A horizontal retainer 44 of rectangular cross section extends downwardly from the head jamb 20, and between the central vertical retainers 40. Upper and lower sealing strips 46 and 48 are mounted on the head jamb 20 and the inner sill 24, respectively, and each strip includes a tongue portion 50 or 52 which projects inwardly from the window frame 12. The tongue portions 50 and 52 are received in respective grooves 54 and 56 in the outer rails 58 and 60 of the upper and lower sashes 16 and 18, respectively.

In the preferred structure, a sill nosing 62 is mounted on the outer end of the inner sill 24. The nosing 62 is an integral one-piece structure, which preferably is extruded of aluminum alloy or other suitable material. The structure includes a base or seat portion 64, which is downwardly and outwardly inclined from the outer or front end surface 66 of the inner sill 24. A mounting panel 68 extends vertically downwardly from the rear edge of the base portion 64 and engages the sill end surface 66. A facing panel 70 extends vertically downwardly from the front edge of the base portion 64.

Two rearwardly extending flanges 71 and 72 on the mounting panel 68 are wedged into a rabbet 74 in the outer end of the sill 24. An additional groove 76 in the sill end serves for reception of a nosing-mounting screw, not shown. A flange 78 depending from the base portion 64 serves as a guide for screws, not shown, connecting the nosing 62 to the combination casing and frame 10.

Referring to FIG. 1, the casing and frame combination 10 is constructed of unitary members, including a normally horizontal top member 80, a pair of normally vertical side members 82 and 84 depending from opposite ends of the top member, and a normally horizontal sill member 86 extending between the lower ends of the side members 82 and 84. The side members 82 and 84 are constructed alike and mounted in the relationship of mirror images.

Figure 4:
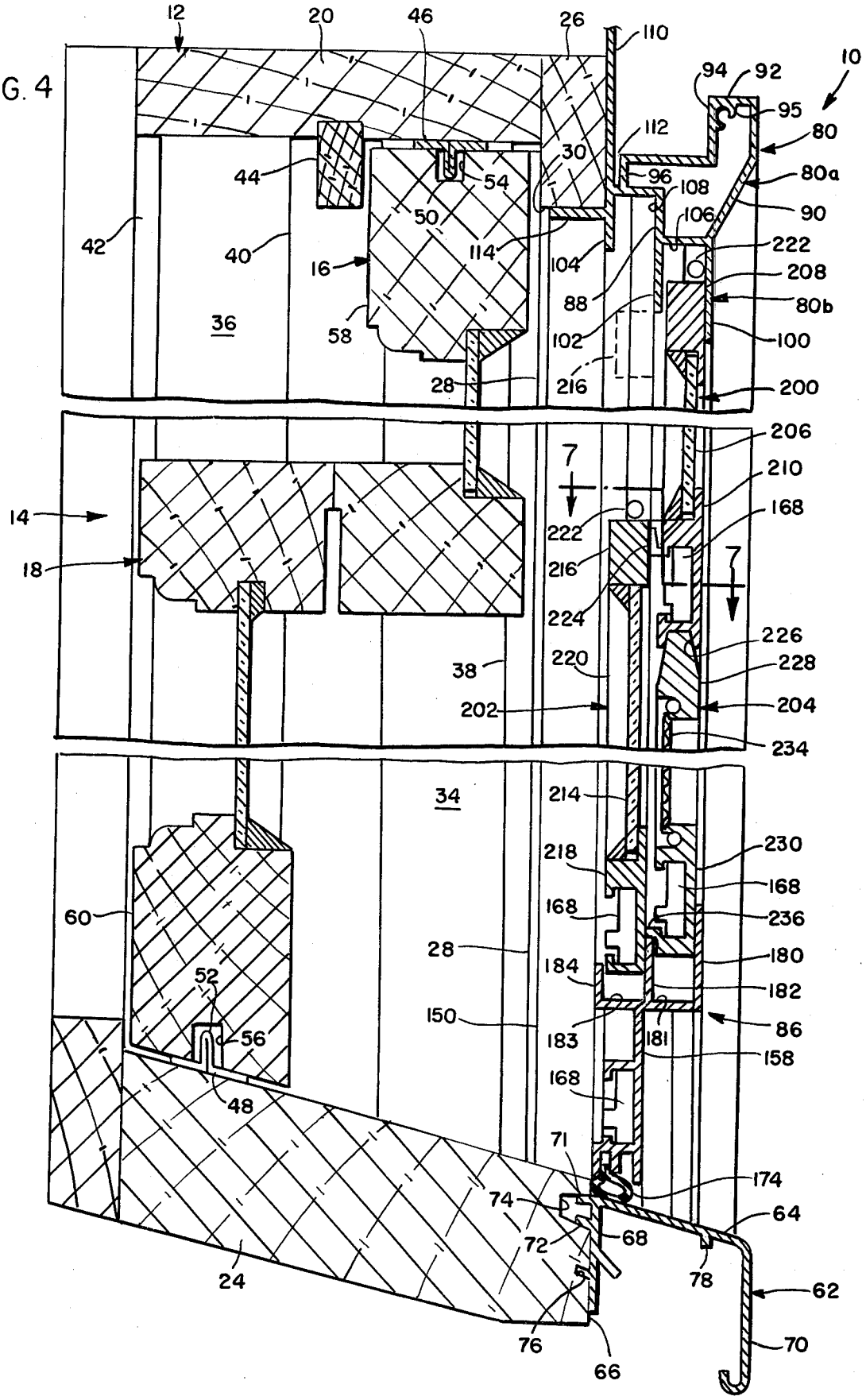
FIG. 4 is an enlarged and broken vertical cross sectional view of the combination casing and frame having sashes mounted thereon, illustrated as mounted on the structural window frame, taken substantially on line 4—4 of FIG. 1 and with certain conventional parts illustrated schematically.

The top member 80 extends across the top of the window frame 12 for the width of the window opening 30, and portions extend a short distance therebeyond. Referring particularly to FIG. 4, the top member 80 includes an elongated closed tubular casing portion **80*a* and an integral substantially coextensive elongated channel-containing frame portion 80*b*. A stepped wall 88** is common to the casing and frame portions and extends for the length thereof.

The casing portion **80*a* also includes a decorative front wall 90, having an obtuse angular configuration. Thus, the front wall 90 extends upwardly and outwardly and then vertically with respect to the common wall 88, in parallel to the horizontal blind stop 26. A top wall 92 of the casing portion 80*a* extends rearwardly from the upper end of the front wall 90, and is stepped to provide a siding-receiving recess 94 adjacent to the horizontal blind stop 26. A recessed screw-receiving internal boss 95 is formed on the top wall 92 at a corner formed thereby. The closed tubular structure of the casing portion 80*a* is completed by a rear wall 96, which extends vertically upwardly from the common wall 88 adjacent to the horizontal blind stop 26. The several walls 88, 90, 92, and 96 also extend longitudinally of the top member 80 and horizontally across the window frame 12**.

The frame portion **80*b*, in addition to the common wall 88, includes spaced parallel front, intermediate, and rear flanges 100, 102, and 104, respectively. The flanges extend from the common wall 88 in vertical directions, progressively farther inwardly from the rear flange 104 to the front flange 100. The flanges 100, 102, and 104 also extend longitudinally of the top member 80 and horizontally across the window frame 12. The flanges are spaced apart for greater distances than the thicknesses of storm window sashes, described subsequently. The flanges and the common wall 88 together form inwardly opening front and rear channels 106 and 108, respectively, which may receive the top ends of the storm window sashes. The channels 106 and 108 are disposed adjacent to each other in vertically staggered relationship, with the rear channel 108 extending vertically upwardly for a greater distance than the front channel 106**.

A flat mounting fin or flange 110 extends vertically upwardly from the common wall 88, for the length of the top member 80, as a continuation of the rear flange 104. The fin 110 is spaced slightly from the rear wall 96 of the casing portion **80*a*, to provide a narrow vertical slot-like recess 112 therebetween. The fin 110 engages the face of the horizontal blind stop 26** and may be secured to the stop by nails or other suitable fastening means.

A flat locating flange 114 extends horizontally rearwardly from the rear channel-defining flange 104, intermediate the ends of the latter flange and perpendicular to the plane thereof. The locating flange 114 extends substantially for the width of the window opening 30, and its upper surface engages the horizontal inner surface of the horizontal blind stop 26. The mounting fin 110 and the locating flange 114 thus provide means for mounting the top member 80 of the combination casing and frame 10 directly against the horizontal blind stop 26, with the casing portion **80*a*** of the top member overlying the blind stop.

The side members 82 and 84 extend along the sides of the window frame 12 for the height of the window opening 30, and portions extend a short distance thereabove. As illustrated in FIG. 1, the upper ends of the side members 82 and 84 abut on the opposite ends of the top member 80 at mitered joints 118 and 120, respectively, and the side members extend downwardly into abutting engagement with the upper surface of the base portion 64 of the sill nosing 62.

Figure 6:
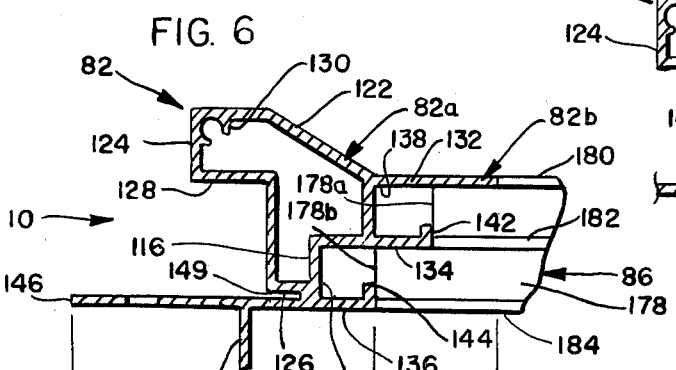
FIG. 6 is a fragmentary horizontal sectional view of the combination casing and frame, taken substantially on line 6—6 of FIG. 5.
Figure 5:
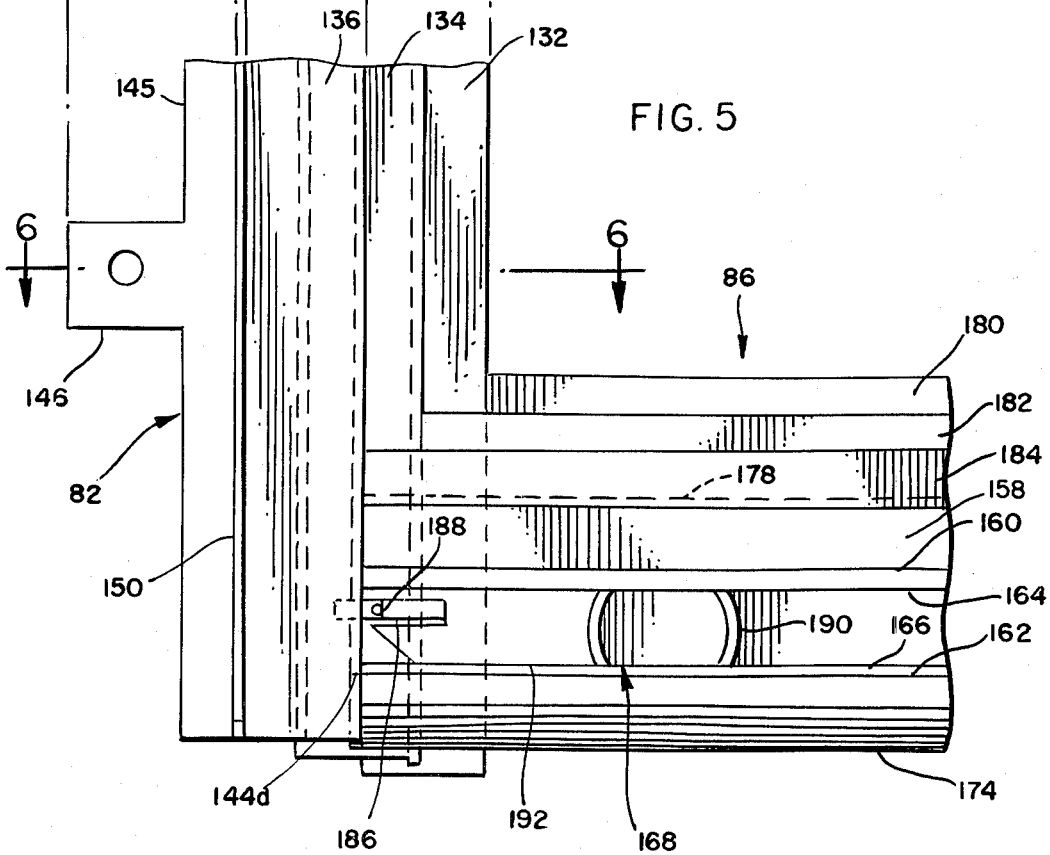
FIG. 5 is a fragmentary rear elevational view of the combination casing and frame, showing the corner thereof which is illustrated in FIG. 2, on substantially the same scale as FIG. 4.

Referring especially to FIGS. 5 and 6, where one side member 82 is illustrated as representative of both side members 82 and 84, the side member 82, like the top member 80, includes an elongated closed tubular casing portion 82*a* and an integral substantially coextensive elongated channel-containing frame portion 82*b* having a common stepped vertical wall 116. The casing portion 82*a* also includes a decorative front wall 122, having an obtuse angular configuration, a stepped outer side wall 124, and a rear wall 126. The several walls 116, 122, 124, and 126 are like the common wall 88, the front wall 90, the top wall 92, and the rear wall 96, respectively, of the casing portion 80*a* in the top member 80. The front wall 122 extends obliquely outwardly and to the side from the common wall 116, and then extends in parallel to a vertical blind stop 28. A siding-receiving recess 128 is provided in the outer side wall 124, adjacent to the vertical blind stop 28. A screw-receiving recessed boss 130 is provided within the casing portion 82*a* at the juncture of the front and side walls 122 and 124.

The frame portion 82*b* of the side member 82 includes front, intermediate, and rear flanges 132, 134, and 136, in spaced parallel relation, which extend inwardly from the common wall 116, similarly to the respective front, intermediate and rear flanges 100, 102, and 104 of the frame portion 80*b* in the top member 80. Together with the common wall 116, the front flange 132 and the intermediate flange 134 define a front channel 138, and the intermediate flange 134 and the rear flange 136 define a rear channel 140. The side member flanges extend progressively farther inwardly from the rear flange 136 to the front flange 132, and the rear channel 140 extends outwardly to the side farther than the front channel 138.

Second flanges 142 and 144 extend laterally from the inner ends of the respective intermediate and rear flanges 134 and 136, at right angles thereto. The second flanges 142 and 144 extend in the direction of the front flange 132, and they are spaced from the front flange and from the intermediate flange 134, respectively.

Figures 2, 3:
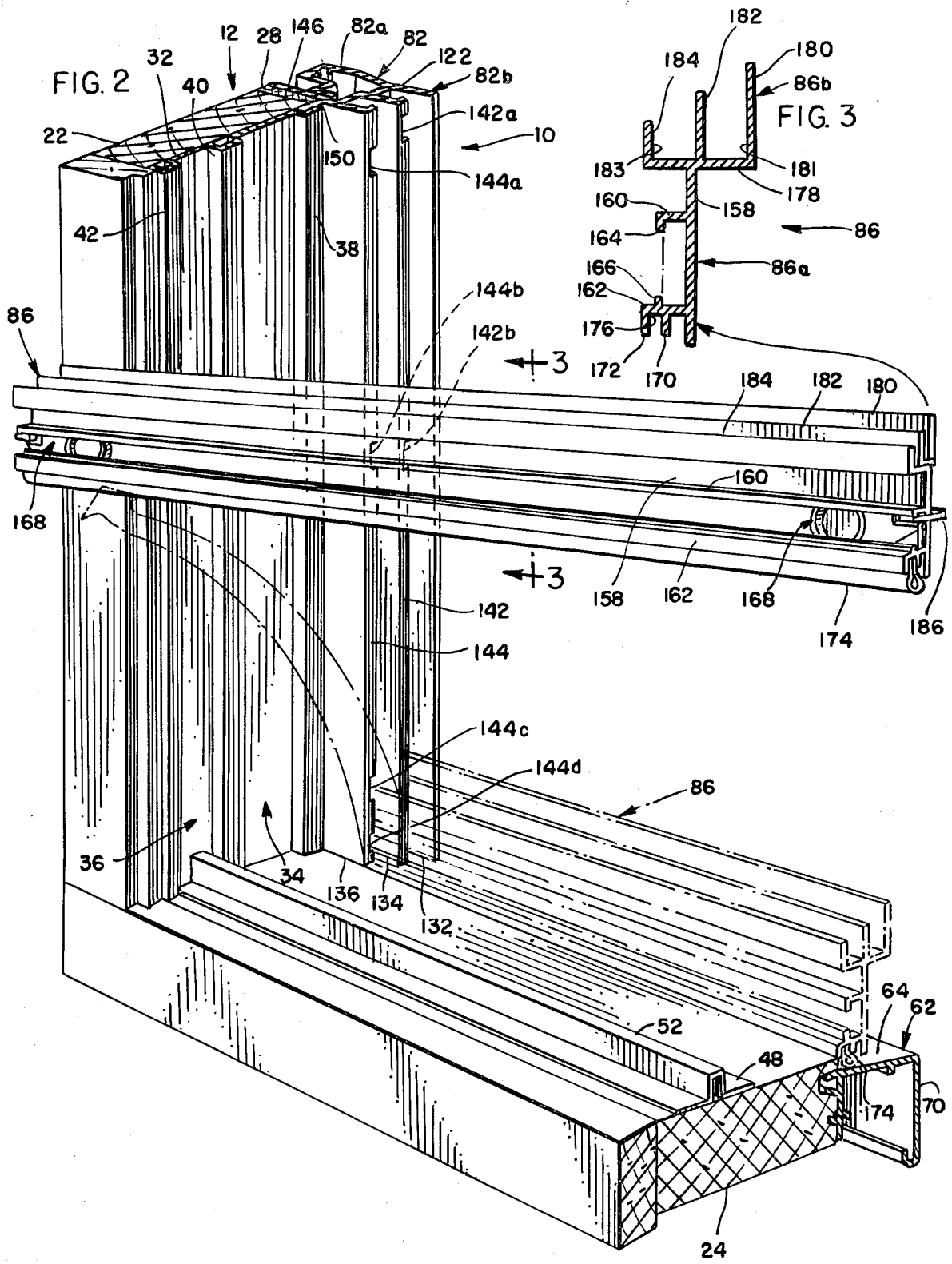
FIG. 2 is an enlarged fragmentary perspective view of a lower corner of the combination casing and frame as mounted on the structural window frame, taken in the direction of the arrow in FIG. 1 and shown as viewed from the rear of the window, with a sill member shown in phantom lines as mounted and in full lines as demounted.
FIG. 3 is a further enlarged cross sectional view of the sill member, taken substantially on line 3—3 of FIG. 2.

The second flanges 142 and 144 together with the intermediate and rear flanges 134 and 136, respectively, provide tracks for sliding movement of sashes on the side member. Also, latch-receiving notches or recesses are provided in the second flanges 142 and 144. As seen in FIG. 2, the second flange 142 on the intermediate flange 134 is provided with an upper notch 142*a* approximately at the center of the side member 82, and with a lower notch 142*b* spaced between that notch and the bottom of the side member. Uppermost and intermediate notches 144*a* and 144*b*, respectively, are provided in the second flange 144 on the rear flange 136, at approximately the same altitudes as the respective notches 142*a* and 142*b*. In addition, lower intermediate and lowermost notches 144*c* and 144*d*, respectively, are provided in spaced apart relation in the second flange 144 near to and spaced above the bottom of the side member 82.

A flat mounting strip or flange 145 (FIG. 5) extends outwardly to the side and for the length of the side member 82, as a continuation of the rear flange 136. Vertically spaced apart tabs 146 are integral with the strip 145 and extend outwardly therebeyond. A narrow slot-like recess 149 is formed between the strip 145 and the rear wall 126 of the casing portion 82*a*. A locating flange 150 extends rearwardly from the strip 145 at right angles thereto and coextensively therewith. The strip 145 and the tabs 146 are adapted to engage the face surface of a vertical blind stop 28 (see FIG. 2), and the locating flange 150 is adapted to abut against the inner side surface of the stop, for the purpose of mounting the side member 82 on the frame 12. The side member 82 is secured in place by nails 152 (FIG. 1) driven through the tabs 146 into the stop 28, or by other suitable fastening means. The mounting strips 145 with integral tabs 146, and the locating flanges 150 thus provide means for mounting the side members 82 and 84 directly against the vertical blind stops 28, with the casing portions 82*a* of the side members overlying the blind stops.

The side members 82 may be rigidly secured to the top member 80 by screws 154 and 156 (FIG. 1) inserted into engagement in the bosses 95 (FIG. 4) and 130 (FIG. 6), respectively, in the top and side members. The members being assembled together in this manner, the front, intermediate, and rear flanges 132, 134, and 136 of the side members 82 and 84 are aligned with or lie substantially in common planes with the respective front, intermediate, and rear flanges 100, 102, and 104 of the top member 80.

Referring especially to FIGS. 1–3, the sill member 86 extends horizontally between the side members 82 and 84 at the bottom of the casing and frame combination 10, where the sill member seats on the base portion 64 of the sill nosing 62. The sill member 86 is an integral one-piece structure of a mounting portion 86*a* and a frame portion 86*b*.

The mounting portion 86*a* includes a vertically disposed upstanding elongated support panel or plate 158, and a pair of vertically spaced parallel latch-mounting flanges 160 and 162 extending rearwardly in perpendicular relation to the panel. A downwardly extending retention rib 164 on the upper mounting flange 160, and an upwardly extending retention rib 166 on the lower mounting flange 162 are spaced rearwardly from the panel 158, and serve to retain conventional latch mechanisms 168 therebetween, on the inside of the mounting portion. Two weather strip-holding flanges 170 and 172 extend downwardly from the mounting flange 162, in spaced apart parallel relation to the panel 158 and to each other. The flanges serve to retain a portion of a tubular resilient weather strip 174 in a groove 176 defined by the flanges and extending along the bottom of the sill member. The foregoing components of the sill member 86 all extend for the length of the member.

The frame portion 86*b* of the sill member 86 includes an elongated horizontal shoulder 176 integral with the support panel 158 intermediate its side edges and extending for the length of the sill member. Front, intermediate, and rear flanges 180, 182, and 184 extend vertically upwardly from the shoulder 178, integrally therewith, and they extend longitudinally for the length of the sill member. The front and intermediate flanges 180 and 182 define a front channel 181, and the intermediate and rear flanges 182 and 184 define a rear channel 183, both of which channels are directed inwardly from the horizontal plane of the shoulder 178. The flanges extend progressively farther inwardly from the rear flange 184 to the front flange 180. With the sill member 86 mounted in the casing and frame combination 10, its front, intermediate and rear flanges 180, 182, and 184 are aligned or in common planes with the front, intermediate, and rear top member flanges 100, 102, and 104, and with the front, intermediate, and rear side member flanges 132, 134, and 136, respectively.

As seen most clearly in FIGS. 5 and 6, the flanges 180, 182, and 184 and front and rear shoulder portions 178*a* and 178*b* adjacent thereto at opposite ends of the sill member extend progressively farther longitudinally from the front flange 180 to the rear flange 184. When the sill member 86 is mounted on the side members 82 and 84 as part of the storm window frame, the front, intermediate, and rear sill member flanges 180, 182, and 184 abuttingly engage the front, intermediate, and rear side member flanges 132, 134 and 136, respectively, and the front and rear shoulder portions 178*a* and 178*b* abuttingly engage the second flanges 142 and 144, respectively, on the intermediate and rear side member flanges 134 and 136. The support panel 158 lies in a plane adjacent and parallel to the plane of the intermediate side member flanges 134, so that the end front surfaces on the panel 158 supportively engage the rear surfaces of the intermediate flanges 134 of the side members. The foregoing structure serves to provide a relatively rigid assembly of the sill member 86 and the side members 82.

Two latch mechanisms 168 are mounted between the mounting flanges 160 and 162, at opposite ends of the sill member 86. The latch mechanism 168 includes a latch 186 having an outer terminal wedge portion 188, and a finger-operated actuating member 190 connected to the inner end of the latch. A holder 192 is secured in fixed position between the mounting flanges 160 and 162, and the actuating member 190 is longitudinally reciprocally movable in the holder. The latch 186 is biased outwardly by spring means, not shown, contained in the holder 192 in engagement with the actuating member 190. The latch 186 may be retracted by pulling inwardly on the actuating member 190. When the retracted actuating member 190 is released, the wedge portion 188 enters the lowermost notch 144*d* in the second flange 144 on the rear flange 136 of the side member 82, as illustrated in FIG. 5 (see also FIG. 7 for similar latch entry into notch 142*a*). The latch 186 of each of the mechanisms 168 on the sill member 86 is spring-pressed into engagement of its wedge portion 188 with the second flange 144 of one side member 82, to secure the sill member 86 rigidly in place.

As illustrated in FIG. 4, when the sill member 86 is mounted, the weather strip 174 engages the upper surface of the base portion 64 on the sill nosing 62, adjacent to the outer end surface 66 of the inner sill 24, to provide a weatherproof seal. Owing to the described construction, the sill member 86 is easily and rapidly mounted on the side members 82 and 84, and demounted therefrom, simply by operating the latch mechanisms 168 while moving the sill member into and out of engagement with the side members from the rear of the structure.

Figure 7:
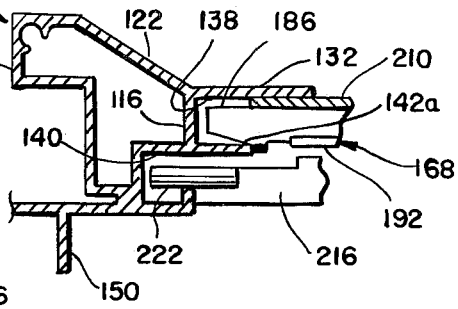
FIG. 7 is a fragmentary horizontal sectional view of the combination casing and frame, and of sashes mounted thereon, taken substantially on lines 7—7 of FIG. 4.

Referring to FIGS. 1, 4 and 7, the combination casing and frame 10 serves to mount conventional upper and lower storm window sashes or sections 200 and 202, respectively, and a conventional screen sash 204 thereon. The upper sash 200 and the screen sash 204 are mounted in the front track section of the casing and frame 10, in registry with the front channel 106 in the top member 80, the front channels 138 in the side members 82 and 84, and the front channel 181 in the sill member 86. The lower sash 202 is mounted in the rear track section, in registry with the rear channel 108 in the top member 80, the rear channels 140 in the side members 82 and 84, and the rear channel 183 in the sill member 86.

The upper sash 202 (FIGS. 1 and 4) includes a glass pane 206 framed by spaced parallel upper and lower frame members 208 and 210, respectively, and spaced parallel side frame members 212. Similarly, the lower sash 202 (FIG. 4) is constructed of a glass pane 214 framed by upper and lower frame members 216 and 218, respectively, and spaced parallel side frame members 220. Outwardly projecting mounting pins 222 are secured on the upper frame members 208 and 216 at opposite ends of each.

The lower frame members 210 and 218 include structure for mounting a latch mechanism 168 at each of the opposite ends thereof, the latch mechanism and mounting structure being conventional and like that described above and illustrated particularly in FIG. 5 for the sill member 86. The lower frame member 210 on the upper storm sash 200 and the upper frame member 216 on the lower storm sash 202 are provided with longitudinally extending flanges between them, which interfit to provide a sealed joint 224, as seen in FIG. 4. The lower frame member 210 of the upper storm sash is provided with a longitudinal screen-receiving groove or recess 226 (FIG. 4).

The screen sash 204 (FIGS. 1 and 4) is constructed similarly to the storm sashes, and it includes spaced parallel upper and lower frame members 228 and 230, and spaced parallel side frame members 232. A mesh screen 234 is mounted on the frame members in a conventional manner. The upper frame member 228 is upwardly tapered, so as to be received in the groove 226 in the lower frame member 210 of the upper storm sash, as illustrated in FIG. 4. The lower frame member 230 includes structure for mounting a latch mechanism 168 at each of its opposite ends, the latch mechanism and the mounting structure being like that described above and illustrated in FIG. 5 for the sill member 86. The lower frame member 230 is provided with a rearwardly extending lip 236.

Referring to FIGS. 4 and 7, the mounting pins 222 on top of the upper storm sash 200 extend into the front channels 138 of the side members 82 and 84, while the side frame members 212 (FIG. 1) ride on the tracks formed by the intermediate flanges 134 and the second flanges 142. When the upper storm sash 200 is in raised position, illustrated in FIG. 4, the latches 186 thereof engage the second flanges 142 adjacent to the opposite sides of the sash in their upper notches 142*a* (FIG. 2). The sash may be lowered to a position in which the latches engage the second flanges 142 in their lower notches 142*b*.

The mounting pins 222 on top of the lower storm sash 202 extend into the rear channels 140 of the side members 82 and 84, while the side frame members 220 ride on the tracks formed by the rear flanges 136 and the second flanges 144. When the lower storm sash 202 is in its lowered position, illustrated in FIG. 4, its mounting pins 222 extend into the rear channels 140 of the side members 82 and 84, and its latches 186 engage the second flanges 144 of the side members in their lower intermediate notches 144*c* (FIG. 2), adjacent to the sill member 86. The lower sash 202 may be raised part way, until its latches 186 engage the second flanges 144 in their intermediate notches 144*b*, or all of the way, as represented in phantom lines in FIG. 4, until the latches 186 enter the uppermost notches 144*a*.

When the storm windows are in use, the storm sashes 200 and 202 are disposed as illustrated in FIG. 4, and the screen sash 204 may remain in the casing and frame 10 or may be removed therefrom. When the screen sash 204 is in use, the lower storm sash 202 may be removed, or may be stored in the raised position illustrated in phantom lines in FIG. 4. The storm sashes 200 and 202 are mounted in a conventional manner: each sash is tilted and cocked, until its mounting pins 222 may be inserted into the side member channels 138 or 140, as the case may be. The sash then is properly oriented, the latches 186 are retracted by operation of the actuating members 190, the bottom end of the sash is positioned properly in registry with the channels 138 or 140 and engaging the tracks formed by the second flanges 142 or 144, and the actuating members are released for engagement of the latches 186 with the second flanges 142 or 144. The latches 186 serve to support the storm sashes at the desired elevations.

With the upper storm sash 200 in raised position and the lower storm sash 202 out of the way, the screen sash 204 is mounted by first inserting its upper frame member 228 in the groove 226 in the lower frame member 210 of the upper storm sash. With the latches 186 retracted, the screen sash then is moved into registry with the side member channels 138 and lowered until its lip 236 is seated on the intermediate flange 182 of the sill member 86. Upon releasing the latches 186, they enter the channels 138 part way, and engage the second flanges 142. The engagement of the latches 186 serves to hold the bottom of the screen sash in place. The several sashes may be removed by reversing the foregoing procedures.

After mounting the combination casing and frame 10 on the structural window frame 12, siding may be applied to the wall of the building and inserted in the recesses 94, 112 of the top member 80, and the recesses 128, 149 of the side members 82 and 84. The wall then is complete, and there is no need for additional casing or framing structure. A pleasing appearance is created, especially by virtue of the integration of the casing and frame portions, and also as a consequence of the resulting relatively wide border formed thereby.

A preferred structure in accordance with the invention has been described and illustrated. It will be apparent to those skilled in the art that various changes and modifications may be made therein within the spirit and scope of the invention. It is intended that such changes and modifications be included within the scope of the appended claims.

I claim as my invention:

1. A combination casing and frame for use both as the window casing and as a storm window frame for a double-hung structural window and adapted to be mounted directly against the frame of the structural window, said combination casing and frame comprising: unitary top, side, and sill members, each of said top and side members having a casing portion adapted to overlie a portion of the structural window frame, means for slidably mounting sashes on said side members, said side members having latch-engaging means, and latches movably mounted on opposite sides of said sill member in retractable engagement with said latch-engaging means for mounting the sill member on the side members and demounting the sill member.

2. A combination casing and frame as defined in claim 1 wherein said casing portions are closed tubular portions; each of said members has flanges which extend inwardly with respect to the periphery of the casing and frame, are aligned with the corresponding flanges on the other members, and form sash-mounting channels; and said flanges of the top and side members extend from said casing portions.

3. A combination casing and frame as defined in claim 2 wherein each of said casing portions defines a siding-receiving recess disposed adjacent to the structural window frame portion which it overlies.

4. A combination casing and frame for use both as the window casing and as a storm window frame for a double-hung structural window and adapted to be mounted directly against the frame of the structural window, said combination casing and frame comprising: unitary top, side, and sill members, each of said top and side members having a casing portion adapted to overlie a portion of the structural window frame, each of said members having front, intermediate, and rear flanges which extend inwardly with respect to the periphery of the casing and frame, are aligned with the corresponding flanges on the other members, and form sash-mounting channels, means on said flanges on the side members providing tracks for sliding movement of sashes on the side members, latch-engaging means on one of said flanges of each of said side members, and latches movably mounted on opposite sides of said sill member in retractable engagement with said latch-engaging means for mounting the sill member on the side members and demounting the sill member.

5. A combination casing and frame as defined in claim 4 wherein said track-providing means includes second flanges extending laterally from said side member flanges, and said latch-engaging means define a latch-receiving notch in a second flange of each side member.

6. A combination casing and frame as defined in claim 5 wherein said side member flanges extend progressively farther inwardly from the rear to the front of the side members, said sill member includes a shoulder extending between its flanges, and said flanges of said sill member and their adjacent shoulder portions at opposite ends of the sill member extend progressively farther longitudinally from front to rear and into abutting engagement thereof with the side member flanges and the second flanges thereon.

7. A combination casing and frame as defined in claim 4 wherein said casing portions are closed tubular portions from which said flanges of the top and side members extend.

8. A combination casing and frame as defined in claim 7 wherein said track-providing means includes second flanges extending laterally from said side member flanges, and said latch-engaging means define a latch-receiving notch in a second flange of each side member.

9. A combination casing and frame as defined in claim 7 wherein each of said casing portions defines a siding-receiving recess disposed adjacent to the structural window frame portion which it overlies.

10. A combination casing and frame for use both as the window casing and as a storm window frame for a double-hung structural window and adapted to be mounted directly against the frame of the structural window, said combination casing and frame comprising: unitary top, side, and sill members, each of said top and side members having a closed tubular casing portion adapted to overlie a portion of the structural window frame, each of said members having front, intermediate, and rear flanges which extend inwardly with respect to the periphery of the casing and frame, are aligned with the corresponding flanges on the other members, and form sash-mounting channels, said flanges of the top and side members extending from said casing portions, second flanges extending laterally from said side member flanges and providing tracks for sliding movement of sashes on the side members, and means defining latch-receiving notches in said second flanges for engaging sash latches.

11. A combination casing and frame as defined in claim 10 and wherein each of said members includes a locating flange projecting perpendicularly rearwardly from the plane of said rear flange of the member and adapted to engage the inner surface of the structural window frame.

12. A combination casing and frame as defined in claim 10 wherein each of said casing portions defines a siding-receiving recess disposed adjacent to the structural window frame portion which it overlies.

13. A combination casing and frame as defined in claim 12 and wherein each of said members includes a locating flange projecting perpendicularly rearwardly from the plane of said rear flange of the member and adapted to engage the inner surface of the structural window frame.

14. In a storm window frame for use with a double-hung structural window, said storm window frame including top and side members, and means for slidably mounting sashes on said side members, the improvement which comprises: latch-engaging means provided in said side members, a sill member mounted on said side members as part of the storm window frame, and latches movably mounted on opposite sides of said sill member in retractable engagement with said latch-engaging means, for mounting and demounting the sill member.

15. A storm window frame as defined in claim 14 wherein each of said members has flanges which extend inwardly with respect to the periphery of the frame, are aligned with the corresponding flanges on the other members, and form sash-mounting channels.

16. A storm window frame as defined in claim 15 and including second flanges extending laterally from said flanges of the side members, and said latch-engaging means define a latch-receiving notch in a second flange of each side member.

17. A storm window frame as defined in claim 16 wherein said side member flanges extend progressively farther inwardly from the rear to the front of the side members, said sill member includes a shoulder extending between its flanges, and said flanges of said sill member and their adjacent shoulder portions at opposite ends of the sill member extend progressively farther longitudinally from front to rear and into abutting engagement thereof with the side member flanges and the second flanges thereon.

18. A storm window frame as defined in claim 17 wherein said sill member includes a support panel extending outwardly from said shoulder in a plane adjacent and parallel to the plane of one of said side member flanges on each of said side members for supporting engagement of the adjacent surfaces of the support panel and the latter flanges at opposite ends of the sill member.

* * * * *